US006766288B1

(12) United States Patent
Smith

(10) Patent No.: US 6,766,288 B1
(45) Date of Patent: Jul. 20, 2004

(54) FAST FIND FUNDAMENTAL METHOD

(75) Inventor: Jack W. Smith, Belle Haven, VA (US)

(73) Assignee: Paul Reed Smith Guitars, Stevensville, MD (US)

( * ) Notice: Subject to any disclaimer, the term of this patent is extended or adjusted under 35 U.S.C. 154(b) by 0 days.

(21) Appl. No.: 09/430,295

(22) Filed: Oct. 29, 1999

Related U.S. Application Data

(60) Provisional application No. 60/106,150, filed on Oct. 29, 1998.

(51) Int. Cl.[7] ..... G10L 11/04
(52) U.S. Cl. ..... 704/207; 704/209
(58) Field of Search ..... 704/500, 501, 704/582, 205, 206, 207, 209; 84/101

(56) References Cited

U.S. PATENT DOCUMENTS

| | | | | |
|---|---|---|---|---|
| 3,591,699 A | | 7/1971 | Coller | |
| 4,018,121 A | * | 4/1977 | Chowning | 84/101 |
| 4,294,153 A | * | 10/1981 | Misuhashi | 84/624 |
| 4,357,852 A | | 11/1982 | Suenaga | |
| 4,429,609 A | | 2/1984 | Warrender | |
| 4,554,855 A | * | 11/1985 | Alonso et al. | 84/622 |
| 4,649,783 A | * | 3/1987 | Strong et al. | 84/606 |
| 4,833,714 A | | 5/1989 | Shimotani et al. | |
| 5,185,806 A | | 2/1993 | Dolby et al. | |
| 5,210,366 A | | 5/1993 | Sykes, Jr. | |
| 5,442,129 A | | 8/1995 | Mohrlok et al. | |
| 5,536,902 A | * | 7/1996 | Serra et al. | 84/623 |
| 5,574,823 A | | 11/1996 | Hassanein et al. | |
| 5,638,454 A | | 6/1997 | Jones et al. | |
| 5,742,927 A | | 4/1998 | Crozier et al. | |
| 5,745,581 A | | 4/1998 | Eatwell et al. | |
| 5,750,912 A | | 5/1998 | Matsumoto | |
| 5,774,836 A | | 6/1998 | Bartkowiak et al. | |
| 5,780,759 A | | 7/1998 | Szalay | |
| 5,824,937 A | | 10/1998 | Szalay | |
| 5,847,303 A | | 12/1998 | Matsumoto | |
| 5,942,709 A | | 8/1999 | Szalay | |
| 5,973,252 A | | 10/1999 | Hildebrand | |
| 5,987,413 A | | 11/1999 | Dutoit et al. | |
| 5,999,897 A | | 12/1999 | Yeldener | |
| 6,035,271 A | * | 3/2000 | Chen | 704/207 |
| 6,057,498 A | * | 5/2000 | Barney | 84/199 |

FOREIGN PATENT DOCUMENTS

| | | | |
|---|---|---|---|
| WO | WO 96/04642 | 2/1996 | G10H/1/06 |

OTHER PUBLICATIONS

An Approach for the Separation of Voices in Composite Musical Signals, by Robert Crawford Maher, Doctor of Philosophy, University of Illinois at Urbana–Champaign.

* cited by examiner

*Primary Examiner*—Richemond Dorvil
*Assistant Examiner*—Angela Armstrong
(74) *Attorney, Agent, or Firm*—Barnes & Thornburg

(57) ABSTRACT

The present invention contains three methods for quickly deducing the fundamental frequency of a complex wave form or signal. One method uses the relationships among the frequencies of higher harmonics including ratios of frequencies, differences between frequencies, ratios of frequency differences, and relationships stemming from the fact that harmonic frequencies are modeled by functions of an integer variable whose values represent harmonic ranking numbers. Another method depicts the predicted/modeled relationships of the harmonics of selected frequency registers on logarithmic scales, records the frequencies of detected partials on like scales, and moves the scales searching for a match of harmonics. Possible harmonic ranking numbers and the implied fundamental frequency can be extracted directly from a match. By still another method, harmonic frequencies for a plurality of fundamentals are compared to partials linked to an unknown fundamental, and the unknown fundamental is deduced.

49 Claims, 6 Drawing Sheets

STEP 1. SET CONSTANTS FOR INSTRUMENT OR SOURCE ($F_H$, $F_L$, $F_{MAX}$, $G(n)$, $K_1$, $K_2$, $K_3$)

STEP 2. SELECT THREE CANDIDATE FREQUENCIES.

STEP 3. DESIGNATE CANDIDATE FREQUENCIES $f_H$, $f_M$, $f_L$.

STEP 4. DETERMINE POSSIBLE TRIOS $R_H$, $R_M$, $R_L$ FOR $f_H$, $f_M$, $f_L$.

STEP 5. DISQUALIFY TRIOS WHICH IMPLY $f_1 < F_L$ OR $f_1 > F_H$.

STEP 6. FORM FREQUENCY DIFFERENCE RATIOS.

STEP 7. INITIALLY QUALIFY.

STEP 8. DISQUALIFY DIFFERENCE RATIO WHICH IMPLIES $f_1 < F_L$.

STEP 9. DISQUALIFY RANKING NUMBER TRIOS WHICH ARE INCONSISTANT WITH DIFFERENCE RATIOS.

STEP 10. DOES ONE OR MORE CONSISTANT TRIOS OF RANKING NUMBERS REMAIN? YES → 17
NO ↓

STEP 11. ALL FREQUENCIES SELECTED? YES → 16
NO ↓

STEP 12. $1^{ST}$? NO → $3^{RD}$? NO → 14
YES ↓ YES → 15

STEP 13. SELECT NEW FREQUENCY. YES ↓

STEP 14. REPLACE ONE OF THE FREQUNCIES IN THE TRIO $f_H$, $f_M$, $f_L$ WITH THE NEW CANDIDATE → 3

STEP 15. SELECT 2 NEW FREQUNCIES. → 3

STEP 16. SET THE $f_1$ EQUAL TO THE LOWEST CANDIDATE FREQUENCY.

STEP 17. DEDUCE $f_1$.

FIG. 2

FAST FIND FUNDAMENTAL METHOD

CROSS-REFERENCE

This application is related to and claims the benefit of Provisional Patent Application Serial No. 60/106,150 filed Oct. 29, 1998 which is incorporated herein by reference.

BACKGROUND AND SUMMARY OF THE INVENTION

This invention relates to electronic music production and reproduction and to methods for modifying electronic analogs of sound during the process of amplifying and enhancing the signals generated by a note, and in general to systems having the objective of quickly determining the fundamental frequency of a compound wave which is the sum of multiple frequencies.

There is an irreducible minimum limit to the length of time required to measure the frequency of a sine wave signal to a specified pitch accuracy (e.g., to ¼ of a semitone). That minimum time is inversely proportional to the frequency of the signal being processed. Keeping pitch accuracy constant, the minimum amount of time required to measure the frequency of a pure sine wave of 82.4 Hz would be eight times longer than the minimum time required to measure the frequency of a pure sine wave of 659.2 Hz. Accordingly, the lag time for measuring and reproducing the fundamental frequencies of low bass notes which are produced by instruments not incorporating keyboards (or other means of revealing the fundamental frequency as a note is sounded) is problematic. For example, when the signals from low bass notes are processed by synthesizers before they are amplified and reproduced, an annoying lag time commonly results.

Throughout this patent, a partial or partial frequency is defined as a definitive energetic frequency band, and harmonics or harmonic frequencies are defined as partials which are generated in accordance with a phenomenon based on an integer relationship such as the division of a mechanical object, e.g., a string, or of an air column, by an integral number of nodes. The relationships between and among the harmonic frequencies generated by many classes of oscillating/vibrating devices, including musical instruments, can be modeled by a function G(n) such that $$f_n = f_1 \times G(n)$$

where $f_n$ is the frequency of the $n^{th}$ harmonic, $f_1$ is the fundamental frequency, known as the 1st harmonic, and n is a positive integer which represents the harmonic ranking number. Known examples of such functions are:

$$f_n = f_1 \times n;$$

and, $$f_n = f_1 \times n \times [1+(n^2-1)\beta]^{1/2}.$$

Where β is a constant, typically 0.004.

A body of knowledge and theory exists regarding the nature and harmonic content of complex wave forms and the relationships between and among the harmonic partials produced both by vibrating objects and by electrical/electronic analogs of such objects. Examples of texts which contribute to this body of knowledge are 1) The Physics of Musical Instruments by Fletcher and Rossing, 2) Tuning, Timbre, Spectrum, Scale by Sethares, and 3) Digital Processing of Speech Signals by Rabiner and Schafer. Also included are knowledge and theory concerning various ways to measure/determine frequency, such as fixed and variable band-pass and band-stop filters, oscillators, resonators, fast Fourier transforms, etc. An overview of this body of knowledge is contained in the Encyclopedia Britannica.

Examples of recent patents which specifically address ways to measure a fundamental frequency are:

U.S. Pat. No. 5,780,759 to Szalay describes a pitch recognition method that uses the interval between zero crossings of a signal as a measure of the period length of the signal. The magnitude of the gradient at the zero crossings is used to select the zero crossings to be evaluated.

U.S. Pat. No. 5,774,836 to Bartkowiak et al. shows an improved vocoder system for estimating pitch in a speech wave form. The method first performs a correlation calculation, then generates an estimate of the fundamental frequency. It then performs error checking to disregard "erroneous" pitch estimates. In the process, it searches for higher harmonics of the estimated fundamental frequency.

U.S. Pat. No. 4,429,609 to Warrander shows a device and method which performs an A to D conversion, removes frequency bands outside the area of interest, and performs analysis using zero crossing time data to determine the fundamental. It delays a reference signal by successive amounts corresponding to intervals between zero crossings, and correlates the delayed signal with the reference signal to determine the fundamental.

U.S. Pat. No. 5,210,366 to Sykes, Jr. is a system and method for detecting, separating and recording the individual voices in a musical composition performed by a plurality of instruments. The electrical waveform signal for the multi-voiced musical composition is fed to a waveform signal converter to convert the waveform signal to a frequency spectrum representation. The frequency spectrum representation is fed to a frequency spectrum comparator where it is compared to predetermined stedy-state frequency spectrum representations for a particular musical instrument. Upon detecting the presence of a frequency spectrum representation corresponding to a predetermined steady-state frequency spectrum representation, the detected frequency spectrum representation and measured growth and decay frequency spectrum representations are fed to a waveform envelope comparator and compared to predetermined waveform envelopes, i.e. frequency spectrum representations during the growth, steady-state and transient properties of the detected frequency spectrum representation are recorded and converted to an electrical waveform signal for output as music data for an individual voice.

U.S. Pat. No. 5,536,902 to Serra et al. is a method and apparatus for analyzing and synthesizing a sound by extracting controlling a sound parameter. Analysis data are provided which are indicative of plural components making up an original sound waveform. The analysis data are analysed to obtain a characteristic concerning a predetermined element, and then data indicative of the obtained characteristics is extracted as a sound or musical parameter. The pitch or fundamental frequency is determined by a weighted average of lower order partials.

The present invention is a method to determine harmonics in a compound wave by being performed without knowing or detecting the fundamental frequency. The method includes detecting the higher order partial frequencies of the compoundwave and determining mathematically the harmonic relationship between and among the higher partial frequencies. The fundamental frequency is deduced from the determined harmonic relationship of the detected frequencies and ranking numbers with which they are paired. This can be performed before the fundamental frequency can be measured. Where the compound waves include a plurality set of harmonics, each set is stemming from a different common fundamental frequency, the method is repeated to determine all sets of harmonics in the compound wave.

The present invention is a method to quickly deduce the fundamental frequency of a complex wave form or signal by using the relationships between and among the frequencies of higher harmonics.

The method includes selecting at least two candidate frequencies in the signal. Next, it is determined if the candidate frequencies are a group of legitimate harmonic frequencies having a harmonic relationship. Finally, the fundamental frequency is deduced from the legitimate frequencies.

In one method, relationships between and among detected partial frequencies are compared to comparable relationships that would prevail if all members were legitimate harmonic frequencies. The relationships compared include frequency ratios, differences in frequencies, ratios of those differences, and unique relationships which result from the fact that harmonic frequencies are modeled by a function of a variable which assumes only positive integer values. That integer value is known as the harmonic ranking number. Preferably, the function of an integer variable is $f_n=f_1\times n\times(S)^{\log_2 n}$ where S is a constant and typically, $1\leqq S\leqq 1.003$ and n is the harmonic ranking number. The value of S, hereafter called the sharping constant, determines the degree to which harmonics become progressively sharper as the value of n increases.

Other relationships which must hold if the candidate partial frequencies are legitimate harmonics stem from the physical characteristics of the vibrating/oscillating object or instrument that is the source of the signal, i.e., the highest and lowest fundamental frequencies it can produce and the highest harmonic frequency it can produce.

Another method for determining legitimate harmonic frequencies and deducing a fundamental frequency includes comparing the group of candidate frequencies to a fundamental frequency and its harmonics to find an acceptable match. One method creates a harmonic multiplier scale on which the values of G(n) are recorded. Those values are the fundamental frequency multipliers for each value of n, i.e., for each harmonic ranking number. Next a like scale is created where the values of candidate partial frequencies can be recorded. After a group of candidate partial frequencies have been detected and recorded on the candidate scale, the two scales are compared, i.e., they are moved with respect to each other to locate acceptable matches of groups of candidate frequencies with groups of harmonic multipliers. Preferably the scales are logarithmic. When a good match is found, then a possible set of ranking numbers for the group of candidate frequencies is determined (or can be read off directly) from the harmonic ranking number scale. Likewise the implied fundamental frequency associated with the group of legitimate partial candidate frequencies can be read off directly. It is the frequency in the candidate frequency scale which corresponds to (lines up with) the "1" on the harmonic multiplier scale.

If the function G(n) is different for different frequency registers so that the harmonics in one frequency register are related in ways that are different from the ways they are related in other frequency registers, then different harmonic multiplier scales are generated, one for each of the different frequency registers. Partial frequencies are recorded on the scale appropriate for the frequency register in which they fall and are compared with the harmonic multiplier scale which corresponds to that frequency register.

In another matching method, the candidate frequencies are compared to a plurality of detected measured harmonic frequencies stemming from a plurality of fundamental frequencies. The detected and measured harmonic frequencies are preferably organized into an array where the columns are the harmonic ranking numbers and the rows are the harmonic frequencies organized in fundamental frequency order. When three or more detected partials align sufficiently close to three measured harmonic frequencies in a row of the array, the harmonic ranking numbers and the fundamental are known.

Since the frequencies of the higher harmonics normally can be determined more quickly than the fundamental frequency, and since the calculations to deduce the fundamental frequency can be performed in a very short time, the fundamental frequencies of low bass notes can be deduced well before they can be measured.

Other advantages and novel features of the present invention will become apparent from the following detailed description of the invention when considered in conjunction with the accompanying drawings.

BRIEF DESCRIPTION OF THE DRAWINGS

FIG. 2 is a block diagram of a specific implementation of the method of FIG. 1.

DETAILED DESCRIPTION OF THE PREFERRED EMBODIMENTS

Figure 1:
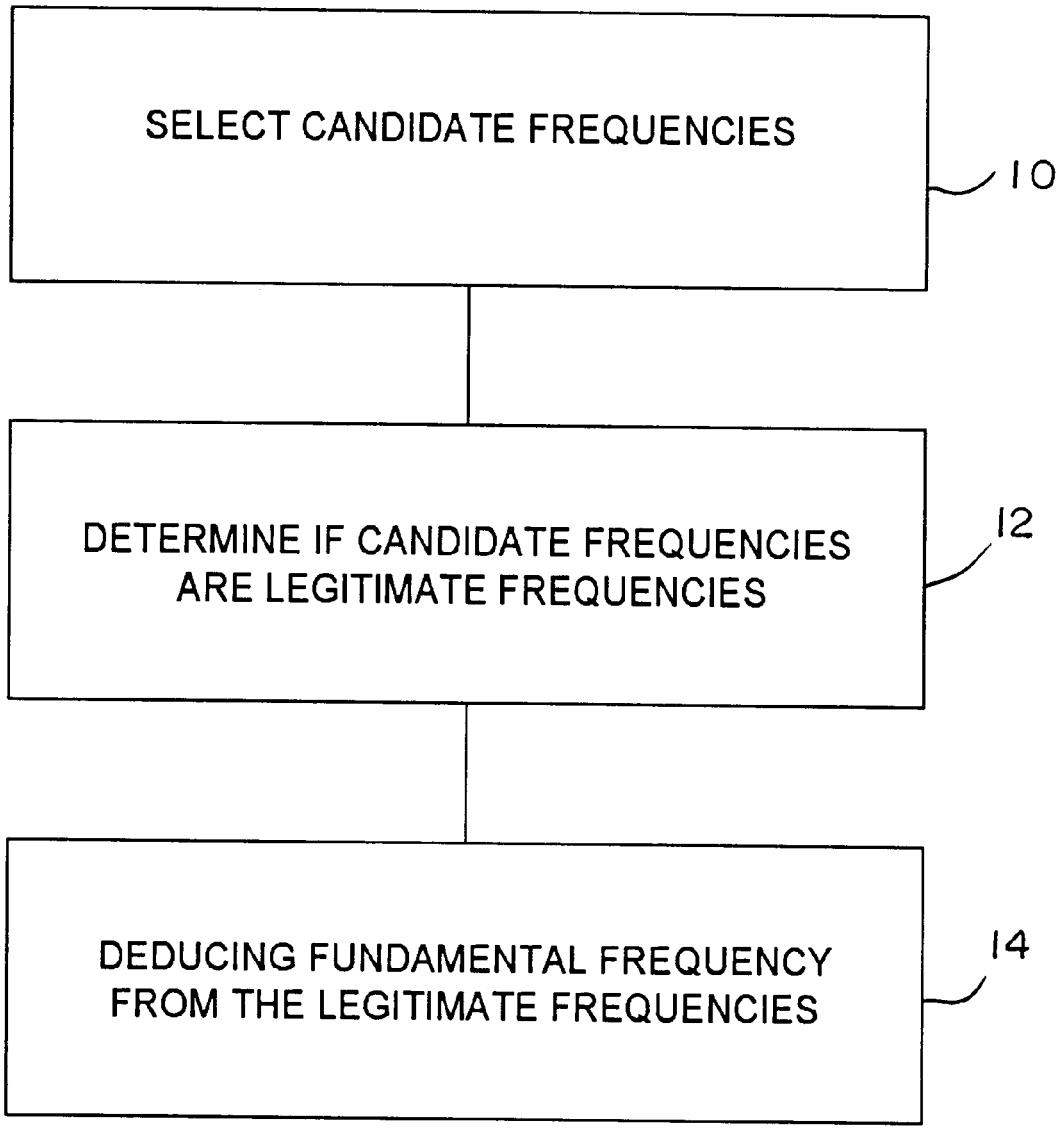
FIG. 1 is a block diagram of a method of deducing the fundamental frequency according to the present invention.

In order to deduce the fundamental frequency, $f_1$, from higher harmonics, anomalous frequencies must be screened out and the harmonic ranking numbers of at least one legitimate harmonic group must be determined. Alternatively, the number of unoccupied harmonic positions (missing harmonics) bracketed by two legitimate harmonics must be determined. The general method, illustrated in FIG. 1, selects candidate frequencies at 10. Next, it determines if the candidate frequencies are legitimate harmonic frequencies having the same underlying fundamental frequency at 12. Finally, the fundamental frequency is deduced from the legitimate frequencies at 14.

Definitions and Notation

The following definitions and notation will be used throughout this patent:

$f_H$, $f_M$, $F_L$ The candidate frequencies of a trio of partials, organized in descending frequency order.

$R_H$, $R_M$, $R_L$: The ranking numbers associated with $f_H$, $f_M$, $f_L$.

$F_L$: The lowest fundamental frequency, $f_1$, which can be produced by the source of the signal.

$F_H$: The highest fundamental frequency, $f_1$, which can be produced by the source of the signal.

$F_{MAX}$: Highest harmonic frequency which can be produced by the source of the signal.

Relationships and Limiting Conditions

The method uses relationships between and among higher harmonics, the conditions which limit choices, the relationships the higher harmonics have with the fundamental, and the range of possible fundamental frequencies. Examples are:

If $f_{R_z}=f_1\times G(R_z)$ models the frequency of the $R_Z^{th}$ harmonic, and If $f_H$, $f_M$ and $f_L$ are legitimate harmonic frequencies, and If $R_H$, $R_M$ and $R_L$, are the ranking numbers associated with $f_H$, $f_M$ $f_L$ then the following ratio relationships must hold:

a) Ratios of detected candidate frequencies must be approximately equal to ratios obtained by substituting their ranking numbers in the model of harmonics, i.e., $$f_H \div f_M \approx f_{R_H} \div f_{R_M}$$

$$f_M \div f_L \approx f_{R_M} \div f_{R_L}$$

b) The ratios of differences between detected candidate frequencies must be consistent with ratios of differences of modeled frequencies, i.e., $$(f_H-f_M)\div(f_M-f_L)\approx(f_{R_H}-f_{R_M})\div(f_{R_M}-f_{R_L})$$

c) The candidate frequency partials $F_H$, $f_M$, $f_L$, which are candidate harmonics, must be in the range of frequencies which can be produced by the source or the instrument.

d) The harmonic ranking numbers $R_H$, $R_M$, $R_L$ must not imply a fundamental frequency which is below $F_L$ or above $F_H$, the range of fundamental frequencies which can be produced by the source or instrument.

e) When matching integer variable ratios to obtain possible trios of ranking numbers, the integer $R_M$, in the integer ratio $R_H/R_M$ must be the same as the integer $R_M$ in the integer ratio $R_M/R_L$, for example. This relationship is used to join Ranking Number pairs $\{R_H, R_M\}$and $\{R_H, R_L\}$ into possible trios $\{R_H, R_M, R_L\}$.

Summary of Methods

The methods analyze a group of partials or candidate frequencies and ascertain whether or not they include anomalous frequencies. Preferably each group analyzed will contain three partials. If the presence of one or more anomalous frequencies is not determined, the group is considered to be a group of legitimate harmonic frequencies. The ranking number of each harmonic frequency is determined, and the fundamental frequency is deduced. When the presence of one or more anomalous frequencies is determined, a new partial or candidate frequency is detected, measured and selected and anomalous frequencies are isolated and screened out. This process continues until a group of legitimate harmonics frequencies remain. In the process, the ranking numbers of legitimate harmonic frequencies are determined and verified. The fundamental frequency is then computed by a variety of methods. Adjustments are made considering the degree to which harmonics vary from $f_n\times f_1\times n$.

Method I

The following is an example of a method implementing the compact flow chart of the method of FIG. 1 to deduce the fundamental frequency and is illustrated in FIG. 2. The method tests a trio of detected candidate partial frequencies to determine whether its members consist only of legitimate harmonic frequencies of the same fundamental frequency. When that is not true, additional candidate frequencies are inducted and substituted for ones in the trio at hand until a trio of legitimate harmonics has been found. When such a trio is found, the ranking numbers associated with each member are determined and the fundamental frequency is deduced.

The method as described herein illustrates the kinds of logical operations that will be accomplished either directly or indirectly. The actual implementation will incorporate shortcuts, eliminate redundancies, etc., and may differ in other ways from the implementation described below.

The method is presented as a set of steps described in general terms and in parallel a numerical example illustrates the required calculations for various steps.

Definitions of Instrument Constants $K_1$ is the highest harmonic ranking number which will be assigned/considered. The value of $K_1$ is set by comparing the expected % error in the measurement of the frequency of the $K_1^{th}$ harmonic with the value of the quotient of the integer ratio $$[(K_1+1)\div K_1]\div[K_1\div(K_1-1)]$$

A default value for $K_1$ will be set equal to 17 and will be revised to conform to knowledge of the instrument at hand and the expected error in frequency measurements.

$K_2$ is the maximum expected number of missing harmonics between two adjacent detected harmonic frequencies. The default value of $K_2$ is set equal to 8.

$K_3$ is equal to the expected maximum sum of the missing harmonics between two harmonics containing one intervening or intermediate harmonic, plus 1. The default value for $K_3$ is set equal to 12.

Step 1. Set constants/parameters for the instrument or signal source.

Example: $F_H$=300 Hz, $F_L$=30 Hz, $F_{MAX}$=2,100 Hz; $K_1$=17, $K_2$=8, $K_3$=12.

For simplicity and brevity, the function describing the relationship between and among harmonic frequencies G(n) is assumed to be $f_1\times n$.

Step 2. Detect, measure and select the frequencies of three partials, for example. The frequencies are detected and measured in the order in which they occur. Three frequencies or partials, having an energy level significantly above the ambient noise level for example, are selected as candidates of possible legitimate harmonics. Higher frequencies, and consequently higher order harmonic frequencies, naturally are detected and measured first. The following example assumes an exception where a lower harmonic is detected before a higher one, and illustrates how that exception would be processed.

Example: $1^{st}$ frequency measured=722 Hz, $2^{nd}$ frequency measured=849 Hz, $3^{rd}$ frequency measured=650 Hz.

Step 3. The three candidate frequencies are arranged in order of frequency and labeled $f_H$, $f_M$, $f_L$.

Example: $f_H$=849 Hz, $f_M$=722 Hz, $f_L$=650 Hz.

Step 4. Possible trios of ranking numbers are determined for the candidate frequencies $f_H/f_M$, $f_L$. The quotients of the ratios $f_H/f_M$ and $f_m/f_L$ are compared to the quotients of integer ratios $I_a/I_b$, where $I_a$ and $I_b$ are both $\leqq k_1$, a given threshold. Here $K_1$ is set equal to 17 for illustrative purposes. When the quotient of a frequency ratio is sufficiently close to the quotient of an integer ratio, that integer ratio is retained as one representing a pair of possible ranking numbers for the frequency ratio it matches. The ratios may also be $f_H/f_L$ and $f_M/f_L$ or $f_H/f_M$ and $f_H/f_L$ or any of the inverses.

Example: For $f_H/f_M$=1.176, the closest integer ratio quotients are 1.1818=13/11 and 1.1667=7/6 or 14/12. Note that 26/22 is not considered because 26>17. For $f_M/f_L$=1.111, the closest integer ratio quotients are 1.111=10/9 and 1.10=11/10.

When the common frequency of the two ratios are equal, then a possible trio of ranking numbers $\{R_H, R_M, R_L\}$ is formed. In this example, it is when the denominator of the integer fraction $f_H/f_M$ is equal to the numerator of the integer fraction $f_M/f_L$.

Example: Since only $f_H/f_M$=13/11 and $f_M/f_L$=11/10 lead to the same ranking number for $f_M$, the only possible trio in this example is $$\{R_H, R_M, R_L\}=\{13, 11, 10\}.$$

Step 5. All possible trios of ranking numbers are eliminated which imply a fundamental frequency $f_1$ outside the range defined by $F_L$ and $F_H$.

Example: The fundamental $f_1$ is the candidate frequency divided by its ranking number. The only possible trio, {13, 11, 10}, is not screened out because $f_H/13$=65.308, $f_M/11$=65.636, and $f_L/10$=65.00 are all within the range defined by $F_L$=30 and $f_H$=300.

Step 6. The differences $D_{H,M}=f_H-f_M$ and $D_{M,L}=f_H-f_L$ are calculated and the ratio $D_{H,M}/D_{M,L}$ is computed Other difference ratios which could have been similarly used are $D_{H,M}/D_{M,L}$ or $D_{H,L}/D_{H,M}$.

Example: $D_{H,M}$=849−722=127, $D_{M,L}$=722−650=72, and $D_{H,M}/D_{M,L}$=127/72=1.764.

Step 7. The quotient of the difference ratio $D_{H,M}/D_{M,L}$ is compared to the quotients of small integer ratios $I_c/I_d$ where $I_c<K_2$, and $I_c+I_d<K_3$. Note: Throughout the example, the value of $K_2$=8 and $K_3$=12. $K_2$=8 corresponds to the assumption that $f_H$ and $f_M$ differ by no more than 7 times the fundamental frequency, or the harmonic ranking numbers $R_H$ and $R_M$ differ by no more than 7. Likewise, $K_3$12 assumes that $f_H$ and $f_L$ will differ by no more than 11 times the fundamental frequency and the ranking numbers $R_H$ and $R_L$ differ by no more than 11. A cursory review of field data confirms these assumptions. If the other difference ratios are used, the values of $K_2$ and $K_3$ are appropriately set using the same analysis.

Example: $D_{H,M}/D_{H,L}$=1.764≈1.75=7/4. This ratio at first qualifies for consideration because 7<8 and 7+4<12.

Step 8. Any difference ratio which implies a fundamental frequency $f_1<F_L$ is disqualified.

Example: Here the difference ratio 7/4 implies that the difference between the highest frequency $f_H$=849 Hz and the lowest frequency $f_L$=650 Hz which equals 198 Hz, should be approximately equal to (7+4) or 11 times the fundamental frequency. Thus, the implication is that $f_1$=199/11=18.1, which is less than $F_L$=30. The same is true for $D_{H,M}/I_c$ and $D_{M,L}/I_d$. This alone implies that one or more anomalous frequencies exist. Step 9 will show that still another comparison implies anomalous frequencies are in this trio of candidate frequencies.

Step 9. Any trio of ranking numbers $R_H$, $R_M$, $R_L$ is disqualified if the integer ratio $I_c/I_d$ which matches the frequency difference ratio is inconsistent with the corresponding ranking number ratios $$(R_H-R_M)\div(R_M-R_L).$$

Example: The only possible ranking number trio was {13, 11, 10}. It is screened out because 7/4≠(13−11)÷(11−10)=2.

Step 10. a) If there are unresolvable inconsistencies, go to Step 11.

Example: The first time through, before a new frequency is selected and anomalous frequencies are eliminated, there were unresolvable inconsistencies. All possible ranking number trios were screened out, and the difference ratio led to an inconsistency.

b) If there are no unresolvable inconsistencies, and a consistent trio has therefore been found to be legitimate, go to Step 17 to deduce the fundamental frequency.

Example: In this case, after a new frequency has been inducted and the $2^{nd}$ frequency in the original trio has been replaced, no unresolvable inconsistencies are found as shown below.

Step 11. Have all the frequencies that have been measured and detected been selected? If no, go to Step 12, if yes, go to Step 16.

Steps 12–14. To find a trio of candidate frequencies, the original three candidate frequencies are used with one or more additional candidate frequencies to determine a legitimate trio. If it is the first time through the process for a trio, proceed to Step 13 to select a fourth candidate frequency and on to Step 14 to replace one of the frequencies in the trio. The determination of a legitimate trio consisting of the fourth candidate frequency and two of the original trio of candidate frequencies is conducted beginning at Step 3.

If the first substitution of the fourth candidate frequency does not produce a legitimate trio, Step 12 proceeds directly to Step 14. A second original candidate frequency is replaced by the fourth candidate to form a new trio. If this does not produce a legitimate trio, the fourth candidate will be substituted for a third original candidate frequency.

If no legitimate or consistent trio has been found after substituting the fourth candidate frequency for each of the frequencies in the original trio, which is determined as the third pass through by Step 12, go to Step 15.

Example: Since there are unresolvable inconsistencies in the original trio {849, 722, 650}, a new frequency is selected. The new frequency is 602 Hz.

The value 849 is replaced by 602 to form the trio {722, 650, 602} which is designated as new candidate trio $\{f_H, f_M, f_L\}$.

For $f_H/f_M$,=1.111, the closest integer ratios are 10/9, 11/10, and 9/8.

For $f_M/f_L$=1.0797, the closest integer ratios are 14/13, 13/12, and 15/14. There are no matching ranking numbers.

Again, no consistent trio is found.

A different frequency in the original trio is replaced, i.e., 722 is replaced by 602 and the original frequency 849 reinserted to form the trio {849, 650, 602} which is designated as new candidate trio $\{f_H, f_M, f_L\}$.

For $f_H/f_M$=1.306, the closest integer ratios are 13/10, 17/13, and 14/11.

For $f_M/f_L$=1.0797, the closest integer ratios are 14/13, 13/12, and 15/14.

$f_H/f_M$≈17/13 and $f_M/f_L$≈13/12 form a possible ranking number trio which is $$\{R_H, R_M, R_L\}=\{17, 13, 12\}.$$

$(f_H-f_M)\div(f_M-f_L)$=199/48=4.146 ≈4.

$(R_H-R_M)\div(R_M-R_L)$=4/1=4, which is consistent with the frequency difference ratio.

Also $f_H \div R_H = 49.94$, $f_M \div R_M = 50$, $f_L \div R_L = 50.17$. All are greater than $f_L = 30$.

All conditions are met and therefore $R_H$, $R_M$, and $R_L$ are assumed to be 17, 13 and 12 respectively and the candidate frequencies 849, 650, 602 are considered a legitimate trio The fundamental frequency is now determined at Step 17.

Step 15. A fifth and sixth candidate frequencies are selected. The fourth frequency is combined with the fifth and sixth candidate frequencies to form a new beginning trio and the method will be executed starting with Step 3. Step 12 will be reset to zero pass throughs.

Step 16: If after all frequencies detected and measured have been selected and determined by Step 11 and no consistent or legitimate trio has been found at Steps 7–10, the lowest of all the frequencies selected will be considered the fundamental.

Step 17. Deduce the fundamental frequency by any one of the following methods for example wherein G(n)=n, $f_H = 849$ Hz, $f_M = 650$ Hz, $f_L = 602$ Hz, $\{R_H, R_M, R_L\} = \{17, 13, 12\}$:

a) $f_1 f_H / R_H$ b) $f_1 = f_M / R_M$ c) $f_1 = f_L / R_L$ d) $f_1 = (f_H - f_M) \div (R_H - R_M)$ e) $f_1 = (f_M - f_L) \div (R_M - R_L)$ f) $f_1 = (f_H - f_L) \div (R_H - R_L)$ Example: After a consistent legitimate trio of frequencies with associate ranking numbers is found to be {849, 650, 602} and {17, 13, 12}:

a) $f_1 = 849/17 = 49.94$ Hz b) $f_1 = 650/13 = 50.00$ Hz c) $f_1 = 602/12 = 50.17$ Hz d) $f_1 = (849-650) \div (17-13) = 49.75$ Hz e) $f_1 = (650-602) \div (13-12) = 48.00$ Hz f) $f_1 = (849-602) \div (17-12) = 49.4$ Hz.

The deduced fundamental could be set equal to any of a variety of weighted averages of the six computed values. For example:

The average value of $f_1$ using the ratio method of computation, e.g., a) through c) above,=50.04 Hz.

The value of $f_1$, considering that frequency difference method which spans the largest number of harmonics, as given by f) above,=49.4.

Averaging the values of $f_1$ computed by the ratio methods and the difference method which spans the greatest number of harmonics gives $$(50.04+49.4) \div 2 = 49.58.$$

These three averaging methods should produce reasonable values for the deduced fundamental frequency. The last is preferred unless/until field data indicate a better averaging method.

b) If the harmonics of the instrument at hand had been modeled by the function $$f_n = f_1 \times n \times (S)^{\log_2 n},$$

where S>1, a more precise method of deducing the fundamental would be as follows:

a) $f_1 = (f_H \div S^{\log_2 R_H}) \div R_H$ b) $f_1 = (f_M \div S^{\log_2 R_M}) \div R_M$ c) $f_1 = (f_L \div S^{\log_2 R_L}) \div R_L$ d) $f_1 = [(f_H \div S^{\log_2 R_H}) - (f_M \div S^{\log_2 R_M})] \div (R_H - R_M)$ e) $f_1 = [(f_M \div S^{\log_2 R_M}) - (f_L \div S^{\log_2 R_L})] \div (R_M - R_L)$ f) $f_1 = [(f_H \div S^{\log_2 R_H}) - (f_L \div S^{\log_2 R_L})] \div (R_H - R_L)$ If the sharping constant S had been set equal to 1.002, the deduced values of the fundamental would have been as follows:

a) $f_1 = 49.535$ Hz.

b) $f_1 = 49.63$ Hz.

c) $f_1 = 49.81$ Hz.

d) $f_1 = 49.22$ Hz.

e) $f_1 = 47.51$ Hz.

f) $f_1 = 48.88$ Hz.

The average value of $f_1$ using the ratio method of computation, e.g., a) through c) above, equals 49.66 Hz.

The value of $f_1$, considering that frequency difference method which spans the largest number of harmonics as given by f) above, equals 48.88 Hz.

Averaging the values of $f_1$ computed by the ratio method and the difference method which spans the greatest number of harmonics gives $$(49.66+48.88) \div 2 = 49.27.$$

Any of these three averaging methods may be used to deduce the fundamental. The last is preferred.

If after Step 9 is completed, two or more consistent sets of ranking numbers remain, the fundamental $f_1$ should be recalculated with each set of ranking numbers and the lowest frequency obtained which is consistent with conditions described in Steps 3 through 9 is selected as the deduced fundamental frequency $f_1$.

The description and examples given previously assume harmonic frequencies are modeled by $$f_n = f_1 \times G(n) = f_1 \times n \times (S)^{\log_2 n}$$

where $1 \leqq S \leqq 1.003$.

The latter function, with S being this close to 1, implies that $f_n/f_m$ will be approximately equal to the integer ratio n/m, that the ratio of the frequency differences $(f_H - f_M) \div (f_M - f_L)$ will be approximately equal to a small integer ratio and that $f_X - f_Y \approx (X-Y) \times f_1$.

In the general case, trios of legitimate harmonic partials are isolated and their corresponding ranking numbers are determined by a) Comparing the quotients of $f_H \div f_M$ and $f_M \div f_1$ to the quotients of ratios $G(R_H) \div G(R_M)$ and $G(R_M) \div G(R_L)$ respectively.

b) Comparing the frequency difference ratios $(f_H - f_M) \div (f_M - f_L)$ with function difference ratios $[G(R_H) - G(R_M)] \div [G(R_M) - G(R_L)]$.

c) Comparing fundamental frequencies that are implied by possible combinations of ranking numbers to both the lowest fundamental frequency and the highest harmonic frequency that can be produced by the instrument at hand.

Method II

Figure 3:
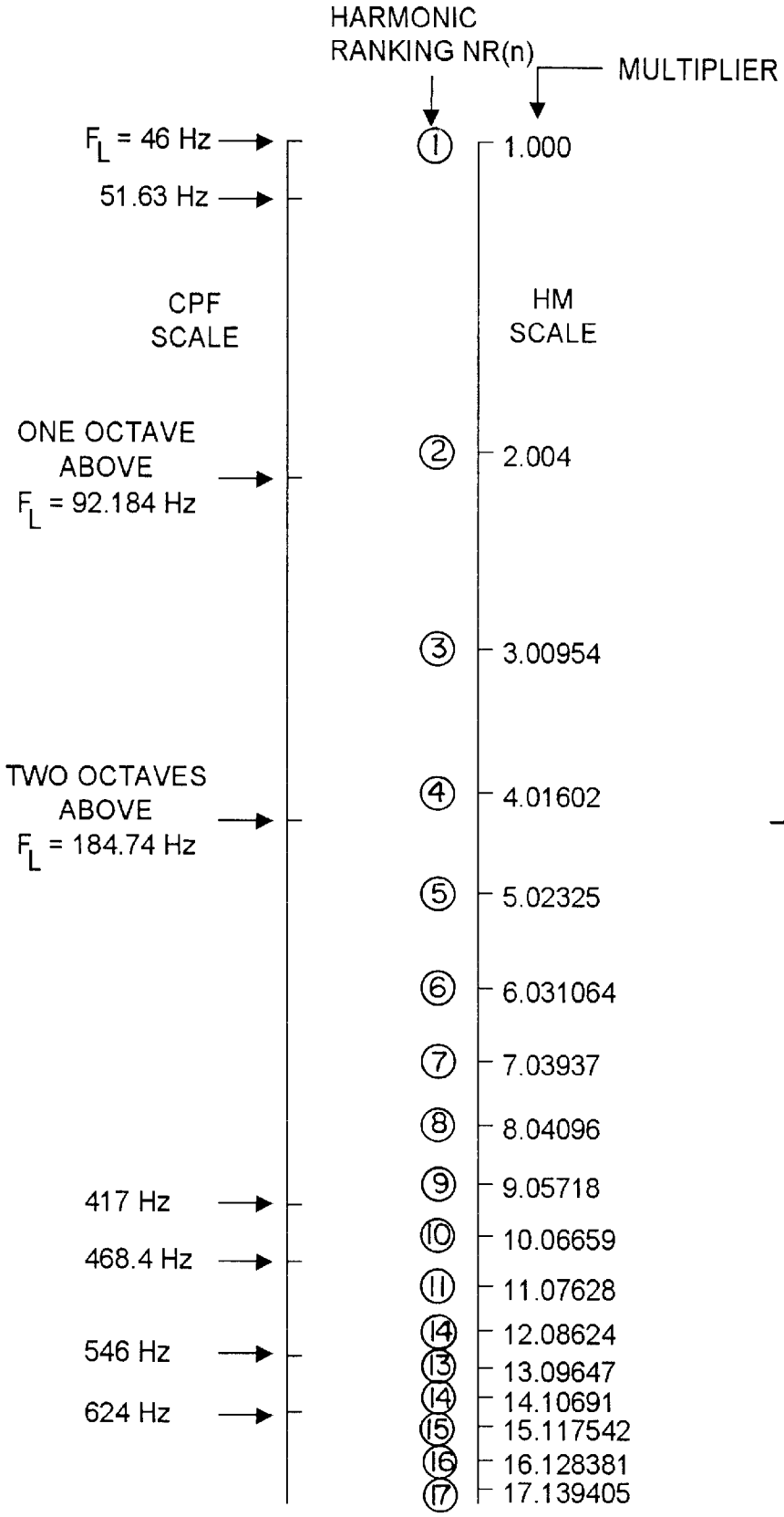
FIG. 3 illustrates a logarithmic scale whereon harmonic multipliers are displayed for Harmonics 1 through 17 and a corresponding logarithmic scale whereon the frequencies of four detected partials are displayed.
Figure 4:
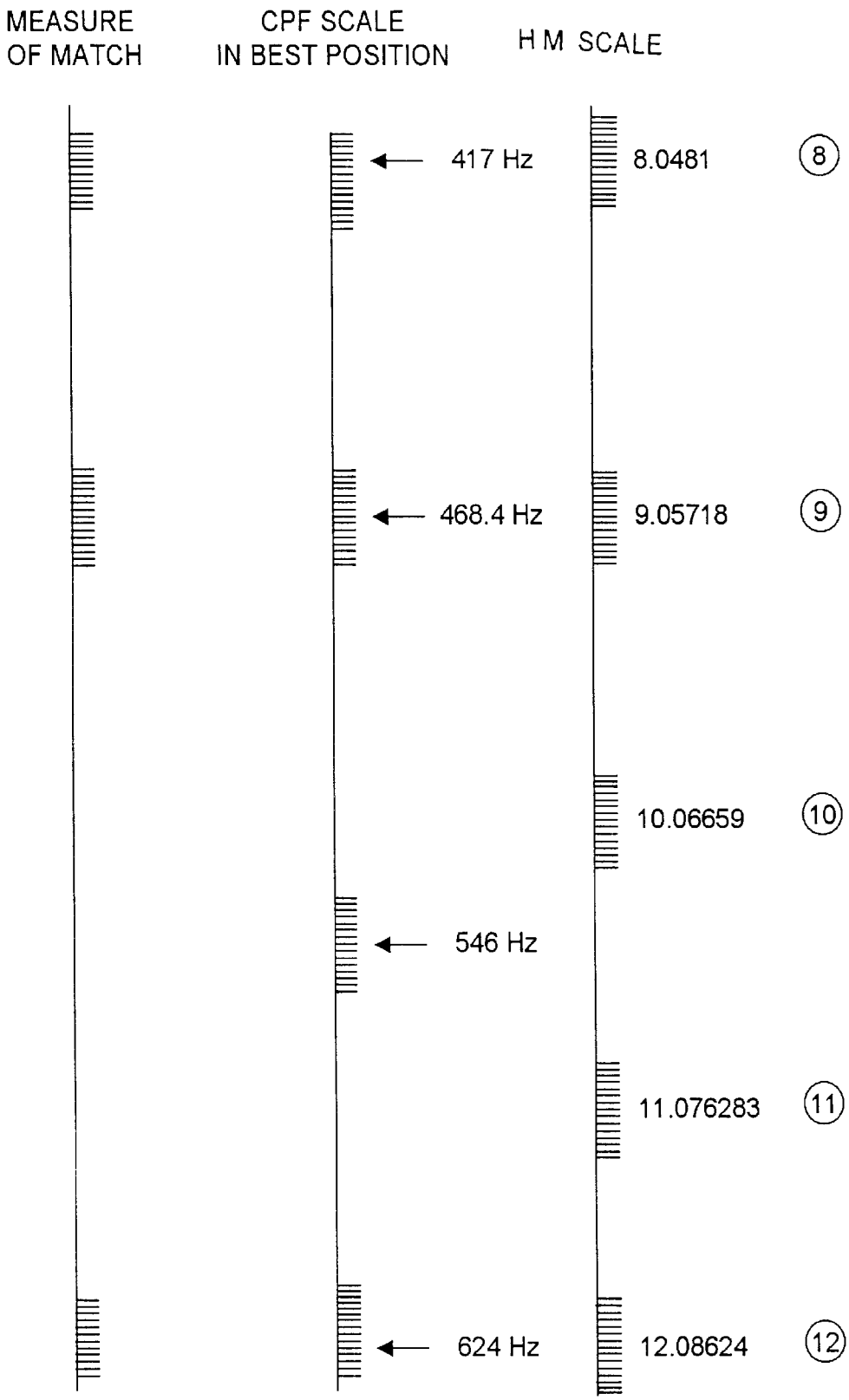
FIG. 4 is an enlargement of a selected portion of the FIG. 3 scales after those scales are moved relative to each other to find a good match of three candidate frequencies with harmonic multipliers.
Figure 5:
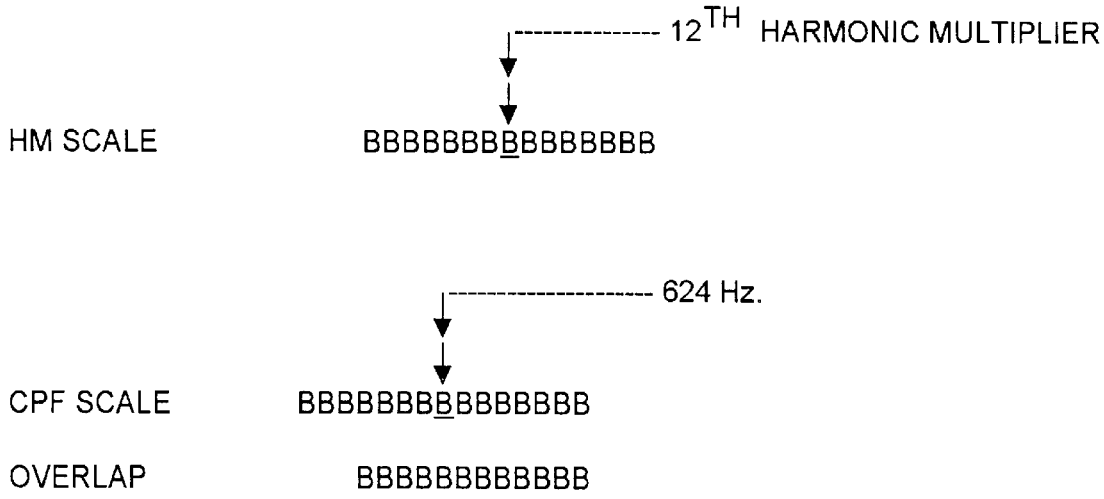
FIG. 5 is an enlargement of a narrow frequency band of FIG. 4 showing how matching bits can be used as a measure of degree of match.

An alternative method for isolating trios of detected partials which consist only of legitimate harmonic frequencies having the same underlying fundamental frequencies, for finding their associated ranking numbers, and for determining the fundamental frequency implied by each such trio is illustrated in FIGS. 3, 4 and 5. The method marks and tags detected partial frequencies on a logarithmic scale and matches the relationships between and among those partials to a like logarithmic scale which displays the relationships between and among predicted/modeled harmonic frequencies.

Hereafter an example is used to clarify the general concepts. It illustrates a method that could be used to match or find a best fit of received signals to the signatures or patterns of harmonic frequencies and only illustrates the kinds of logical operations that would be used. The example should be considered as one possible incarnation and not considered as a limitation of the present invention.

For purposes of this example it is assumed that the harmonics produced by the instrument at hand are modeled by the function $f_n=f_1\times n\times(S)^{\log_2 n}$, where n is a positive integer 1, 2, . . . , 17, and S is a constant equal to 1.002. Based on that function, a Harmonic Multiplier Scale, hereafter called the HM Scale, is established where each gradient marker represents a cent which is 1/100of a semitone or 1/1200of an octave. The first mark on the scale represents the harmonic multiplier 1, i.e., the number which when multiplied by $f_1$ gives $f_1$. Each successive mark on the scale represents the previous multiplier number itself multiplied by $[2\times S]^{1/1200}$. Assume that a string of bits is used each representing one cent. The $n^{th}$ bit will represent the multiplier $[(2\times S)^{1/1200}]^{(n-1)}$. Selected bits along the HM Scale will represent harmonic multipliers and will be tagged with the appropriate harmonic number: $f_1$ will be represented by bit 1, $f_2$ by bit 1200, $f_3$ by bit 1902, $f_4$ by bit 2400, . . . , $f_{17}$ by bit 4905. This scale is depicted in FIG. 3.

Another scale is established for marking and tagging candidate partial frequencies as they are detected. The starting gradient marker, represented by bit 1, will represent the frequency $F_L$; the next by $F_L\times[(2\times S)^{1/1200}]^1$, the next by $F_L\times[(2\times S)^{1/1200}]^2$. The $n^{th}$ bit will represent $F_L\times[(2\times S)^{1/1200}]^{n-1}$. This scale is known as the Candidate Partial Frequency Scale and is hereafter called the CPF Scale. It is depicted along with the HM Scale in FIG. 3.

As partials are detected their frequencies are marked and tagged on the CPF Scale. When three have been so detected, marked and tagged, the CPF Scale is moved with respect to the HM Scale, searching for matches. If a match of the three candidate frequencies is not found anywhere along the scales, another partial frequency is detected, marked and tagged and the search for three that match continues. When members of a trio of candidate partials match a set of multipliers on the CPF Scale to within a specified limit, then the candidate frequencies are assumed to be legitimate harmonic frequencies, their ranking numbers matching the ranking numbers of their counterparts on the CPF Scale. Likewise, the implied fundamental can be deduced directly. It is the frequency position on the CPF matching the "1" on the HM Scale.

FIG. 4 shows the portion of the scales in which the detected candidate frequencies lie after the scales have been shifted to reveal a good alignment of three frequencies, i.e., the $4^{th}$ frequency detected, 421 Hz, combined with the 1st and $3^{rd}$ frequencies detected, 624 Hz and 467 Hz.

One method for measuring the degree of alignment between a candidate partial and a harmonic multiplier is to expand the bits that mark candidate partial frequencies and harmonic multipliers into sets of multiple adjacent bits. In this example, on the HM Scale, 7 bits are turned on either side of each bit which marks a harmonic multiplier. Likewise, on the CPF Scale, 7 bits are turned on either side of each bit marking a candidate partial frequency. As the scales are moved with respect to each other, the number of matching bits provides a measure of the degree of alignment. When the number of matching bits in a trio of candidate frequencies exceed a threshold, e.g., 37 out of 45 bits, then the alignment of candidate partials is considered to be acceptable and the candidate frequencies are designated as a trio of legitimate harmonic frequencies. FIG. 5 illustrates the degree of match, e.g., 12 out of a possible 15, between one candidate partial frequency, i.e., 624 Hz, and the multiplier for the $12^{th}$ harmonic.

When an acceptable alignment or match is found, the implied ranking numbers are used to test for unresolvable inconsistencies using the logical Steps 6 through 9 of Method 1. If no unresolvable inconsistencies are found and the implied fundamental is lower then $F_L$ or higher than $F_H$, then the scales are moved in search of alignments implying a higher fundamental or a lower fundamental respectively. When no unresolvable inconsistencies are found and the implied fundamental lies between $F_L$ and $F_H$, then the implied fundamental $f_1$ becomes the deduced fundamental.

Some classes of instruments/devices have resonance bands and/or registers which produce harmonics which are systematically sharper than those in other resonance bands and/or registers. Likewise, the harmonics of some instruments may be systematic and predictable in some frequency bands and not in others. In these cases, Method II can be used as follows:

1. Isolate the frequency bands where S is consistent throughout the band.
2. Build an HM Scale to be used only for the frequencies in that frequency band based on the S for that band.
3. Build other HM Scales for other frequency bands where different values of S apply.
4. When frequencies are detected, locate them in the CPF Scale which is constructed with the value of S appropriate for the band that contains that frequency.
5. Ignore detected frequencies which lie in frequency bands where the harmonics are not predictable.
6. Search for matches between harmonic multiplier patterns and detected candidate frequency patterns using like scales (same S value).

Method III

Another method of deducing the fundamental frequency entails the detection and measurement or calculation of harmonic frequencies for a plurality of fundamental frequencies. The frequencies are organized in an array with fundamental frequencies being the rows and harmonic ranking numbers being the columns. When a note with unknown fundamental frequency is played, the frequencies of the higher harmonics, as they are detected, are compared row by row to the harmonic frequencies displayed in the array. A good match with three or more frequencies in the array or with frequencies interpolated from members of the array indicate a possible set of ranking numbers and a possible deduced fundamental frequency. When a trio of detected frequencies matches two or more trios of frequencies in the array, and thus two or more fundamental frequencies are implied, the deduced fundamental frequency is set equal to the lowest of the implied fundamental frequencies that is consistent with the notes that can be produced by the instrument at hand. The array is an example of only one method of organizing the frequencies for quick access and other methods may be used.

Methods I, II and III above can be used to isolate and edit anomalous partials. For example, given a monophonic track of music, after all partials have been detected during a period of time when the deduced fundamental remains constant, these methods could be used to identify all partials which are not legitimate members of the set of harmonics generated by the given fundamental. That information could be used, for example, for a) editing extraneous sounds from the track of music; or b) for analyzing the anomalies to determine their source.

Normally three or more legitimate harmonic frequencies will be required by either Method I, II, or III although in some special cases only two will suffice. In order to deduce the fundamental frequency from two high-order harmonics, the following conditions must prevail: a) It must be known that anomalous partial frequencies which do not represent legitimate harmonics are so rare that the possibility can be ignored; and b) The ratio of the two frequencies must be such that the ranking numbers of the two frequencies are uniquely established. For example, suppose the two frequencies are 434 Hz and 404 Hz. The quotient of the ratio of these frequencies lies between 14/13 and 15/14. If $F_L$=30 Hz, then the ranking numbers are uniquely established as 14 and 13, since brake 434÷15=28.9 which is less than 30 and thus disqualified. The difference of the two candidate frequencies is 30, which is acceptable since it is not less than $F_L$. Also, the ratio $(F_H-F_L)\div(R_H-R_L)=30$ which again is not less than $F_L$.

The function $f_n=f_1\times n\times(S)^{\log_2 n}$ is used to model harmonics which are progressively sharper as n increases. S is a sharping constant, typically set between 1 and 1.003 and n is a positive integer 1, 2, 3, . . . , T, where T is typically equal to 17. With this function, the value of S determines the extent of that sharping. The harmonics it models are consonant in the same way harmonics are consonant when $f_n=n\times f_1$. I.e., if $f_n$ and $f_m$ are the $n^{th}$ and $m^{th}$ harmonics of a note, then $$f_n/f_m=f_{2n}/f_{2m}=f_{3n}/f_{3m}=\ldots=f_{kn}/f_{km}$$

where k is a positive integer.

Figure 6:
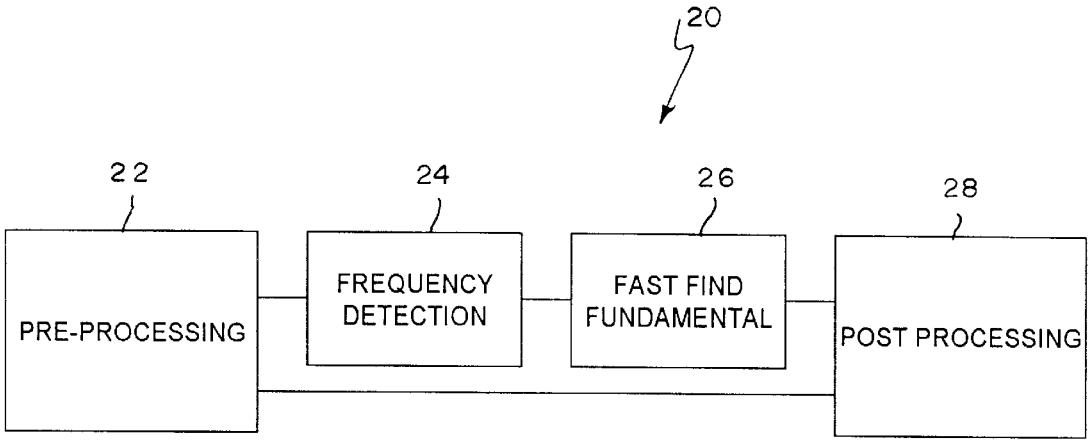
FIG. 6 is a block diagram of a system implementing the method of FIGS. 1–4.

A system 20 which implements the method is shown in FIG. 6. A preprocessing stage 22 receives or picks up the signal from the source. It may include a pickup for a string on a musical instrument. The preprocessing also conditions the signal. This may include normalizing the amplitude of the input signal, and frequency and/or frequency band limiting. Next a frequency detection stage 24 isolates frequency bands with enough energy to be significantly above ambient noise and of appropriate definition.

The fast find fundamental stage 26 performs the analysis of the candidate frequencies and deduces the fundamental. The post processing stage 28 uses information generated by the fast find fundamental stage to process the input signal. This could include amplification, modification and other signal manipulation processing.

The present method has described using the relationship between harmonic frequencies to deduce the fundamental. The determination of harmonic relationship and their rank alone without deducing the fundamental also is of value. The fundamental frequency may not be present in the waveform. The higher harmonics may be used to find other harmonics without deducing the fundamental. Thus, post processing will use the identified harmonics present.

Although the present invention has been described with respect to notes produced by singing voices or musical instruments, it may include other sources of a complex wave which has a fundamental frequency and higher harmonics. These could include a speaking voice, complex machinery or other mechanically vibrating elements, for example.

Although the present invention has been described and illustrated in detail, it is to be clearly understood that the same is by way of illustration and example only, and is not to be taken by way of limitation. The spirit and scope of the present invention are to be limited only by the terms of the appended claims. the present invention are to be limited only by the terms of the appended claims.

What is claimed is:

1. A method to identify which partials are harmonics in a compound wave, the method being characterized by being performed without relying on the fundamental frequency, and the method further comprising:

detecting partial frequencies of the compound wave;

selecting, from the set of detected partial frequencies, a subset of partial frequencies;

identifying mathematically the harmonic relationships among the detected subset of partial frequencies by comparing relationships among the frequencies of the members of the subset with like harmonic relationships among expected frequency values of harmonics derived from a modeling function that depends upon harmonic ranking numbers of harmonic frequencies; and deducing the frequency of at least one other harmonic from the identified harmonic relationship.

2. The method of claim 1, wherein the determining further includes:

determining possible sets of ranking numbers to be paired with members of the subset of partial frequencies by comparing the harmonic relationships among the frequencies of the members of the subset to corresponding modeled harmonic relationships that exist among the frequencies of harmonics as calculated by the modeling function; and selecting a set of consistent ranking numbers from the possible sets of ranking numbers which can be paired with the members of the subset in such away that the harmonic relationships among the members of the subset and the frequencies derived from the modeling function using the ranking numbers with which the members are paired are determinative of the relationships among the frequencies of legitimate harmonics sharing a common fundamental frequency.

3. The method of claim 1 or 2 wherein identifying the harmonic relationships includes comparing frequency ratios and ratios of differences to integer ratios by adjusting the value of the detected frequencies to account for the degree to which harmonic frequencies vary from $f_n=f_1\times n$, where $f_n$ is the frequency of a harmonic and $f_1$ is the fundamental frequency from which it stems and n is an integer, the method further comprising:

adjusting the value of the detected frequencies by the function $$f^*_n=f_n\div[G(n)\div n]$$

where $f_n$ is the detected frequency, G(n) is the function of an integer variable n in the model $f_n=f_1\times G(n)$, and $f^*_n$ is the detected frequency adjusted so that ratios and ratios of differences can be compared directly to integer ratios.

4. The method of claim 3 wherein G(n) is a function of an integer variable by which harmonics are sharper than those that would be produced by the function $f_n=f_1\times n$.

5. The method of claim 4 wherein $G(n)=n\times(S)^{\log_2 n}$ and $f^*_n=f_n\div(S)^{\log_2 n}$.

6. The method of claim 2, wherein the adjusted detected partial frequencies are marked and tagged on a scale, harmonic multiplier values, G(n), are marked and tagged on a like scale, and the scales are moved with respect to each other to find matches.

7. The method according to claim 6, including determining the ranking number of the candidate frequencies from the match of the scales.

8. The method according to claim 7, wherein the scales are logarithmic scales of the same base.

9. The method of claim 1 or 2 including forming new subsets of partial frequencies when previously tested subsets of partial frequencies were not identified to be a group of harmonic frequencies, by the method of:

selecting a new partial frequency from the compound wave;

establishing a new subset such that one of the partial frequencies in the subset previously tested is replaced by the new partial frequency;

designating the subset thus formed to be the new subset of partial frequencies.

10. The method of claim 1 or 2 wherein the subsets of partial frequencies, and the sets of modeled harmonic frequencies contain at least three members.

11. The method of claim 1, whereby harmonic frequencies are modeled by functions in the form of $f_n=f_1\times G(n)$ where $f_n$ is the frequency of the nth harmonic, $f_1$ is the fundamental frequency from which the harmonic stems, and G(n) is a function of an integer variable, n, which takes on only positive integer values, typically 1 through 17.

12. The method of claim 11, wherein $G(n)=n\times(S)^{\log_2 n}$, where S is the harmonic sharping constant, greater than or equal to 1 and typically less than 1.003.

13. The method of claim 11, wherein G(n)=n.

14. The method of claim 1, wherein the identifying of harmonic relationships includes using combinations of one or more of the comparisons A through N below to isolate and authenticate possible sets of ranking numbers to be paired with detected partial frequencies:

A. comparing ratios of detected partial frequencies with ratios of modeled harmonic frequencies;

B. comparing ratios of adjusted detected partial frequencies with ratios of small integers;

C. comparing differences between detected partial frequencies with differences between modeled harmonic frequencies;

D. comparing differences between adjusted detected partial frequencies with differences between small integers;

E. comparing ratios of differences between adjusted detected partial frequencies with ratios of differences between small integers;

F. comparing ratios of differences between pairs of detected partial frequencies linked by a common detected partial frequency with ratios of differences between pairs of modeled harmonic frequencies linked by a common modeled harmonic frequency;

G. comparing ratios of differences of pairs of adjusted detected partial frequencies with ratios of differences of small integers linked by a common integer, said integers being considered as possible ranking numbers to pair with the detected partial frequencies;

H. comparing ratios of differences between pairs of detected partial frequencies linked by a common detected partial frequency with ratios of the differences between the ranking numbers which may be paired with the detected partial frequencies;

I. comparing detected partial frequencies divided by ranking numbers with which they might be paired with fundamental frequencies that can be produced by sources of the compound wave;

J. comparing ratios of differences between adjusted detected partial frequencies with ratios of differences between ranking numbers with which they might be paired;

K. comparing logarithms of detected partial frequencies with logarithms of modeled harmonic frequencies or with logarithms of harmonic multipliers, G(n);

L. comparing a scale where detected partial frequencies are marked and tagged with a like scale where modeled harmonic frequencies or harmonic multipliers, G(n), and their ranking numbers are marked and tagged;

M. comparing a logarithmic scale where logarithms of detected partial frequencies are marked and tagged with a like scale where logarithms of modeled harmonic frequencies or logarithms of harmonic multipliers, G(n), and their ranking numbers are marked and tagged; and N. comparing detected partial frequencies to calculated and/or previously detected harmonic frequencies having a broad range of ranking numbers and stemming from a plurality of fundamental frequencies, all organized by fundamental frequency and harmonic ranking number.

15. The method according to claim 14, wherein one set of comparisons is used to isolate sets of detected partial frequencies and ranking numbers with which they might be paired, and another set is used to authenticate the ranking number pairings and isolate detected partial frequencies which are legitimate harmonics.

16. The method according to claim 15, wherein combinations of comparisons A, B, D E and G are used to isolate sets of ranking numbers paired with detected partial frequencies, and comparisons I, H and G are used to authenticate them.

17. The method according to claim 15, wherein comparison M is used to isolate sets of ranking numbers paired with detected partial frequencies, and comparisons A, B, F and I are used to authenticate them.

18. The method according to claim 15, wherein N is used to isolate sets of ranking numbers paired with detected partial frequencies, and combinations of comparisons A through I are used to authenticate them.

19. The method according to claim 1, including selecting three detected partial frequencies and identifying the harmonic relationship includes using one or more of ratios of the selected partial frequencies, differences of the selected partial frequencies, and ratio of differences of the selected partial frequencies.

20. The method according to claim 19, including determining three harmonic ranking numbers for the selected partial frequencies from the ratios of the three selected partial frequencies.

21. The method according to claim 19, including determining ratios of integers which are substantially equal to the ratios of the selected partial frequencies and determining harmonic ranking numbers for each selected partial frequency from a match of a number from the integer ratios of one of the selected partial frequency with the other two selected partial frequencies.

22. The method according to claim 1 or 2, wherein the fundamental frequency is deduced using one or more of the frequencies of the subset being divided by its ranking number and differences of the frequencies of the subset being divided by differences of their ranking numbers.

23. The method of claim 6, wherein the fundamental frequency is determined by a weighted average of frequencies of the subset divided by their ranking numbers and of differences between those frequencies divided by the differences between their ranking numbers.

24. The method of claim 1, wherein identifying harmonic relationships includes isolating possible subsets of legitimate harmonic frequencies from the set of detected partial frequencies and corresponding ranking numbers with which they can be paired by comparing one or more of a) order, b) ratios, c) differences and, d) ratios of differences of detected partial frequencies to corresponding one or more of a) order, b) ratios, c) differences and, d) ratios of differences of modeled harmonic frequencies.

25. The method of claim 24, wherein ratios are compared by comparing their quotients.

26. The method of claim 24, wherein comparisons are made by marking and tagging detected partial frequencies on a scale, marking modeled harmonic frequencies on a like scale, and moving the scales with respect to each other to find matches.

27. The method of claim 24, wherein detected partial frequencies are matched with values in an array of historical or calculated harmonic frequencies organized by frequency in fundamental frequency order and by ranking number.

28. The method of claim 1 or 2 wherein identifying harmonic relationships includes authenticating subsets of detected frequencies and corresponding ranking numbers with which they are paired by comparing one or more of a) ratios and, b) ratios of differences of adjusted detected partial frequencies with corresponding one or more of a) integer ratios and, b) ratios of differences of integers.

29. The method of claim 28, including adjusting detected partial frequencies using the method of claim 3.

30. The method of claim 28, wherein the comparisons include comparisons of quotients of ratios.

31. The method of claim 28, wherein the comparisons include comparing frequency and frequency difference quotients to quotients of small integer ratios.

32. The method of claim 1, wherein subsets of detected frequencies are eliminated if no sets of ranking numbers with which they can be paired can be authenticated.

33. The method of claim 1 or 2 wherein identifying harmonic relationships includes authenticating or eliminating the detected frequencies together with the ranking numbers with which they are paired by comparing the fundamental frequencies which they imply with fundamental frequencies that could be produced by sources of the compound wave.

34. The method of claim 1 or 2 wherein identifying harmonic relationships includes matching the detected partial frequencies with values in an array of historical or calculated harmonic frequencies organized by frequency in fundamental frequency order and by ranking number.

35. The method of claim 1, wherein the members of subset of detected partial frequencies are designated as legitimate harmonic frequencies if they have been authenticated, and if the sets of ranking numbers with which they have been paired are authenticated.

36. The method of claim 35, wherein the fundamental frequency is deduced from the authenticated candidate harmonic frequencies and their corresponding ranking numbers, and including picking the lowest fundamental frequency if two or more sets of ranking numbers have been authenticated.

37. The method of claim 1 or 2, including discarding sets of possible ranking numbers which imply fundamental frequencies that could not have been produced by sources of the compound wave.

38. The method of claim 1 or 2, further including deducing the fundamental frequency from the identified harmonic relationship of the detected frequencies and ranking numbers with which they are paired.

39. The method of claim 1 wherein the decuced harmonic includes the fundamental frequency of the identified harmonic relationship.

40. A method for isolating a set of measured partial frequencies in a compound wave whose members are legitimate harmonics having a harmonic relationship and stemming from the same fundamental frequency, the method comprising:

a. selecting a set of partial frequencies of the compound wave;

b. identifying one or more sets of harmonic frequencies which are based on models such that the ratios of modeled frequencies within a given set are substantially equal to ratios of corresponding selected partial frequencies;

c. designating the partial frequencies as candidate harmonics and designating the corresponding ranking numbers of the matching identified harmonic frequencies as a consistent set of ranking numbers with which said candidate harmonics can be paired;

d. authenticating each consistent set of ranking numbers which when matched against the candidate frequencies designated by c. yield ratios which are substantially equal to the ratios of the candidate frequencies;

e. determining the fundamental frequencies implied by each of the sets of ranking numbers with which the candidate harmonic frequencies can be paired and authenticated as per Step d. above;

f. further authenticating the matched pairs of candidate harmonic frequencies and ranking numbers which imply fundamental frequencies that can be produced by sources of the compound wave; and g. designating the authenticated candidate harmonics as a set of partial frequencies which are legitimate harmonic frequencies; or h. repeating the process a. through g. above for a new set of partial frequencies of the compound wave when the original set cannot be designated legitimate harmonic frequencies.

41. The method as in any of claim 1, 2 or 40 including storing the method as instructions in and performing the method on a digital signal processor.

42. The method of claim 1, 2, or 40, wherein the method is preformed before the fundamental frequency can be measured.

43. The method of claim 1, 2, or 40, wherein the compound wave includes plural sets of harmonics, each set stemming from a different common fundamental frequency; and the method is repeated to determine all sets of harmonics in the compound wave.

44. A method to identify which partials are harmonics in a compound wave, the method being characterized by being performed without relying on the fundamental frequency, and the method further comprising:

detecting partial frequencies of the compound wave;

adjusting the detected frequencies to account for the degree to which harmonic frequencies vary from $f_n = f_1 \times n$, where $f_n$ is the frequency of a harmonic and $f_1$ is the fundamental frequency from which it stems and n is an integer; and identifying mathematically the harmonic relationships among the adjusted detected partial frequencies.

45. A method for isolating a set of measured partial frequencies in a compound wave whose members are legitimate harmonics having a harmonic relationship and stemming from the same fundamental frequency, the method comprising:

a. selecting a set of partial frequenceis of the compound wave;

b. identifying one or more sets of harmonic frequencies which are based on models such that the ratios of frequencies within a given set are substantially equal to ratios of selected partial frequencies;

c. designating the partial frequencies as candidate harmonics and designating corresponding ranking numbers of the matching identified harmonic frequencies as a consistent set of ranking numbers with which said candidate harmonics can be paired;

d. authenticating each consistent set of ranking numbers which when matched against the candidate frequencies determined by c. yield ratios which are substantially equal to the ratios of the candidate frequencies;

e. further authenticating the matched pairs of candidate harmonic frequencies and ranking numbers; and f. designating the authenticated candidate harmonics as a set of partial frequencies which are legitimate harmonic frequencies; or g. repeating the process a. through f. above for new set of partial frequencies of the compound wave when the original set cannot be designated legitimate harmonic frequencies.

46. A method of measuring the fundamental frequency of at least one harmonic spectrum that resides within a compound wave, comprising;

detecting partial frequencies in the compound wave;

determining whether at least three of the detected partials are part of the same harmonic spectrum, such determination made by mathematically verifying the existence of a mathematical relationship among the detected partials that is consistent with a harmonic spectrum;

the determining further including determining harmonic ranking numbers which can be paired with the three partial frequencies by mathematically verifying that the harmonic relationships among the three partial frequencies is consistent with the corresponding modeled harmonic relationships that are calculated using the modeling function, the same ranking number candidates and the same fundamental frequency; and calculating the fundamental of the harmonic spectrum using the verified mathematical relationship.

47. The method of claim 46 where the mathematical relationship in the determining step is one of:

A. comparing ratios of detected partial frequencies with ratios of modeled harmonic frequencies;

B. comparing ratios of adjusted detected partial frequencies with ratios of small integers;

C. comparing differences between detected partial frequencies with differences between modeled harmonic frequencies;

D. comparing differences between adjusted detected partial frequencies with differences between small integers;

E. comparing ratios of differences between adjusted detected partial frequencies with ratios of differences between small integers;

F. comparing ratios of differences between pairs of detected partial frequencies linked by a common detected partial frequency with ratios of differences between pairs of modeled harmonic frequencies linked by a common modeled harmonic frequency;

G. comparing ratios of differences of pairs of adjusted detected partial frequencies with ratios of differences of small integers linked by a common integer, said integers being considered as possible ranking numbers to pair with the detected partial frequencies;

H. comparing ratios of differences between pairs of detected partial frequencies linked by a common detected partial frequency with ratios of the differences between the ranking numbers which may be paired with the detected partial frequencies;

I. comparing detected partial frequencies divided by ranking numbers with which they might be paired with fundamental frequencies that can be produced by sources of the compound wave;

J. comparing ratios of differences between adjusted detected partial frequencies with ratios of differences between ranking numbers with which they might be paired;

K. comparing logarithms of detected partial frequencies with logarithms of modeled harmonic frequencies or with logarithms of harmonic multipliers, G(n);

L. comparing a scale where detected partial frequencies are marked and tagged with a like scale where modeled harmonic frequencies or harmonic multipliers, G(n), and their ranking numbers are marked and tagged.

M. comparing a logarithmic scale where logarithms of detected partial frequencies are marked and tagged with a like scale where logarithms of modeled harmonic frequencies or logarithms of harmonic multipliers, G(n), and their ranking numbers are marked and tagged; and N. comparing detected partial frequencies to calculated and/or previously detected harmonic frequencies having a broad range of ranking numbers stemming from a plurality of fundamental frequencies, all organized by fundamental frequency and harmonic ranking number.

48. A method to identify which partials are harmonics in a compound wave, the method comprising:

detecting partial frequencies of the compound wave;

adjusting the detected frequencies to account for the degree to which harmonic frequencies vary from $f_n=f_1\times n$, where $f_n$ is the frequency of harmonic and $f_1$ is the fundamental frequency from which it stems and n is an integer; and identifying mathematically the harmonic relationships among the adjusted detected partial frequencies.

49. The method of claim 48, wherein the adjustment is $f_n=f_1\times n\times(S^{\log_2 n}$, where S is a harmonic sharping constant, greater than or equal to 1 and typically less than 1.003.

* * * * *